US011401098B2

(12) United States Patent
Schultz et al.

(10) Patent No.: US 11,401,098 B2
(45) Date of Patent: Aug. 2, 2022

(54) TWIST RING CONTAINER

(71) Applicant: MUNCHKIN, INC., Van Nuys, CA (US)

(72) Inventors: Anya Schultz, Granada Hills, CA (US); Ho Wing Tak, Hong Kong (CN); Agnes Yena Lee, Los Angeles, CA (US); Sung Yun Chan, Pasadena, CA (US)

(73) Assignee: Munchkin Inc., Van Nuys, CA (US)

( * ) Notice: Subject to any disclaimer, the term of this patent is extended or adjusted under 35 U.S.C. 154(b) by 221 days.

(21) Appl. No.: 16/807,133

(22) Filed: Mar. 2, 2020

(65) Prior Publication Data

US 2020/0277124 A1 Sep. 3, 2020

Related U.S. Application Data

(60) Provisional application No. 62/812,825, filed on Mar. 1, 2019.

(51) Int. Cl.

| | |
|---|---|
| ***B65D 81/36*** | (2006.01) |
| ***B65D 47/20*** | (2006.01) |
| ***B65D 53/02*** | (2006.01) |
| ***B65D 43/02*** | (2006.01) |
| ***B65D 25/20*** | (2006.01) |
| ***B65D 51/16*** | (2006.01) |

(52) U.S. Cl.

CPC ..... *B65D 81/36* (2013.01); *B65D 25/205* (2013.01); *B65D 43/0231* (2013.01); *B65D 47/2031* (2013.01); *B65D 51/16* (2013.01); *B65D 53/02* (2013.01)

(58) Field of Classification Search

CPC .. B65D 81/36; B65D 25/205; B65D 43/0231; B65D 47/2031; B65D 51/16; B65D 53/02

USPC ..... 222/192; 446/71; 220/319, 703, 711, 220/717; 215/11.1, 352, 376, 395

See application file for complete search history.

(56) References Cited

U.S. PATENT DOCUMENTS

| | | | | |
|---|---|---|---|---|
| 5,525,383 | A | 11/1996 | Witkowski | |
| 5,884,421 | A * | 3/1999 | Key | G09F 3/02 40/306 |
| 6,109,996 | A * | 8/2000 | Ma | A45C 1/12 70/289 |
| 6,213,616 | B1 | 10/2001 | Chen | |
| 7,252,204 | B1 * | 8/2007 | Small | E05B 37/02 215/208 |
| 7,806,296 | B2 * | 10/2010 | Connors | B65D 81/363 222/78 |
| 8,122,626 | B2 | 2/2012 | Schnuckle | |
| 9,911,347 | B2 * | 3/2018 | Dore | G09B 19/0023 |

(Continued)

FOREIGN PATENT DOCUMENTS

| | | | |
|---|---|---|---|
| CN | 2740083 | Y | 11/2005 |

*Primary Examiner* — Lien M Ngo
(74) *Attorney, Agent, or Firm* — Robert Z. Evora, Esq.

(57) ABSTRACT

An assembly having a container, one or more rings around the container, and a base which secures the rings to the container. The container may also, in some embodiments, have a solid lid or flexible lid that is secured to the container with a lid collar. The ring or rings are stacked upon one another when placed on the container. When assembled, the rings are able to freely rotate with respect to each other and the container body. The container is useful as an entertainment integrated with a drinking vessel in addition to many other useful applications.

20 Claims, 13 Drawing Sheets

(56) References Cited

U.S. PATENT DOCUMENTS

| | | | | |
|---|---|---|---|---|
| 10,538,368 | B2 * | 1/2020 | Resnikoff | B65D 47/06 |
| 10,968,029 | B1 * | 4/2021 | Rane | B65D 81/383 |
| 2006/0040581 | A1 * | 2/2006 | Davis | A63F 9/001 446/71 |
| 2009/0300955 | A1 * | 12/2009 | Puglisi | G09F 23/00 40/334 |
| 2010/0314399 | A1 * | 12/2010 | George | G09F 23/00 220/600 |

* cited by examiner

TWIST RING CONTAINER

CROSS REFERENCE TO RELATED APPLICATION

This application claims priority to U.S. Provisional Application Ser. No. 62/812,825 filed Mar. 1, 2019, the contents which are hereby incorporated by reference herein in their entirety into this disclosure.

TECHNICAL FIELD

The subject disclosure relates to a twist ring container. More particularly, to a vessel having one or more external, movable, removable, ring-like components.

BACKGROUND

There exist numerous drinking vessels on the market. Frequently small children have either consecutive or concurrent needs for drinking and to be entertained. In the normal course of events these needs are provided for by more than one object such as a toy and a cup. When small children switch from satisfying one need to the other, they are liable to lose, drop, or otherwise mislocate one or both of these objects as their attentions shift. The twist ring container provides a solution for both needs in one object thereby decreasing the likelihood that a mislocation will occur, requiring the intervention of another person or upsetting the child.

SUMMARY

An assembly having a container, one or more rings around the container, and a base which secures the rings to the container. The container may also, in some embodiments, have a solid lid or flexible lid with or without a spout that is secured to the container with a lid ring. The rings are stacked upon one another when placed on the container. When assembled, the rings are able to freely rotate with respect to each other and the container body. The container is useful as an entertainment integrated with a drinking vessel in addition to many other useful applications.

BRIEF DESCRIPTION OF THE DRAWINGS

Various exemplary embodiments of this disclosure will be described in detail, wherein like reference numerals refer to identical or similar, components or steps, with reference to the following figures, wherein.

DETAILED DESCRIPTION

Figure 1:
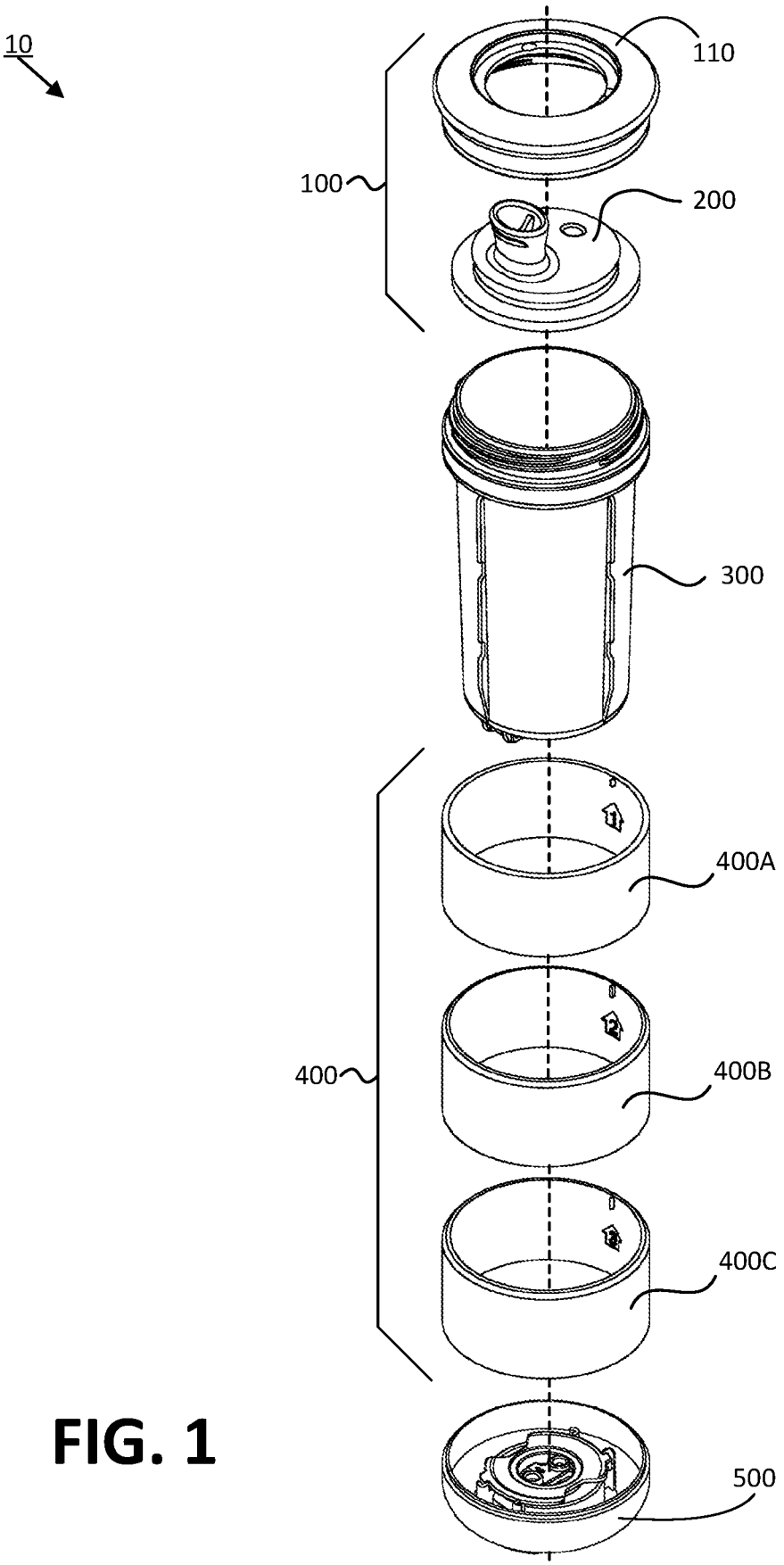
FIG. 1 is an exploded perspective view of an embodiment of a twist ring container according to the subject disclosure.

Particular embodiments of the subject disclosure will now be described in greater detail with reference to the figures.

FIGS. 1-15 show various aspects of a twist ring container 10 having a lid assembly 100, a container body 300, image rings 400, and a base 500. The twist ring container 10 is useful for supplying a drinking vessel and entertainment in a single object. The twist ring container 10 is also useful for other purposes as described below.

The twist ring container 10 may have one or more freely rotating image ring(s) 400 on the outside of the container body 300 that display information. The image ring(s) 400 are removable for cleaning or may be replaced with different image ring(s) 400. The image ring(s) 400 are secured onto the container body 300 with the base 500 while still able to freely rotate. The twist ring container 10 is useful as a puzzle or other entertainment while also functioning as a drinking vessel for beverages such as water, juices, teas, coffee, soda, and the like. The twist ring container 10 can also be adapted to store other substances or objects such as oil, chemicals, snacks, small parts, paint, tools, and the like. It is also contemplated that various sized embodiments of the twist ring container 10 also can be adapted to hold larger items or larger quantities of fluids for a variety of purposes such as indicating information about the contents (hazardousness, required regulatory placarding, empty/full, pH, etc.), the status of the contents (clean or dirty, in process or completed, new or used, etc.), and the like.

Various additional features may be added to the twist ring container 10 according to this subject disclosure. For example, a sleeve or other outer shell with or without a window (not depicted) to a section of the image ring(s) 400 or other aesthetic additions (not shown) may be provided to limit the viewing to the section of the image ring(s) 400 not covered by the sleeve or shell. Additionally, feet made of rubber, cork, or similar material (not pictured) may be added to the base 500 to aid in gripping a flat surface when the twist ring container 10 is upright. The twist ring container 10 may be constructed of plastic, metal, wood, ceramic, glass, or like materials. The fact that these possible embodiments are not illustrated is not an intention to exclude those or other features not mentioned here. The figures and descriptions contained herein are only one of many possible embodiments and are not exclusive of others.

In FIG. 1 the twist ring container 10 is depicted in an exploded upper perspective view. The lid assembly 100 is shown having a lid collar 110 and a flexible lid 200. As will be described below, the flexible lid 200 may fit into the lid collar 110 to form the lid assembly 100. The lid assembly 100 may then attach to the container body 300. The flexible lid 200 acts as a seal between the lid collar 110 and the container body 300. This will be explained in greater detail below.

As shown in FIG. 1, the image rings 400 may comprise a top image ring 400A, one or more middle image ring(s) 400B, and a bottom image ring 400C. The twist ring container 10 is depicted as comprising one top image ring 400A, one middle image ring 400B, and one bottom image ring 400C. It is further contemplated that the subject disclosure could contain any number of image rings 400, from at least one to any greater number. The image rings 400 are differentiated in the present disclosure to facilitate a description on how the structure of the image rings 400 might differ in certain embodiments, depending on their intended position with respect to one another; this described feature is not intended to exclude designs containing any number of image rings 400 that are enabled by the subject disclosure.

The base 500 is shown attached to the container body 300 after the image rings 400 have been installed. The base 500 secures to the container body 300 and holds the image rings 400 on the container body 300. The base 500 is secured onto the container body 300 such that the image rings 400 can still freely rotate with respect to the fixed components of the twist ring container 10 (comprising the lid assembly 100, the container body 300, and the base 500) as well as with respect to one another.

Figure 2:
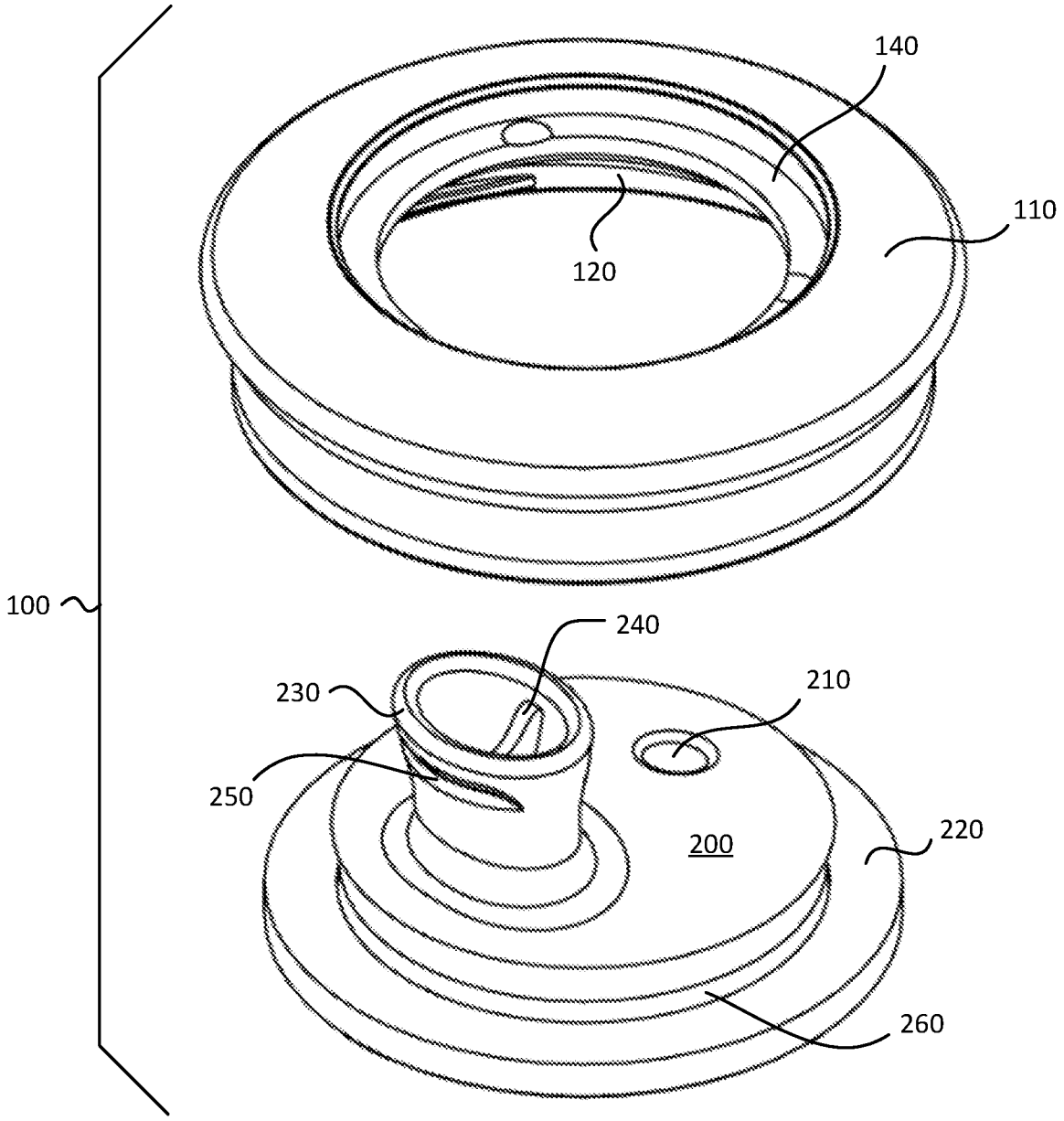
FIG. 2 is an upper perspective view of a lid assembly.

FIG. 2 depicts an exploded view of the lid assembly 100 of the twist ring container 10 in a disassembled state. Illustrated is the lid collar 110 and the flexible lid 200, along with some of their individual features. The lid collar 110 is shown as having collar threads 120 located on the inside edge and a top collar shoulder 140 recessed from the top.

The flexible lid 200 is depicted as having: an air valve 210, an extended skirt 220, a top seal channel 260, and a spout 230 with a bite valve 270 (depicted in FIGS. 10-11), spout reinforcement 240, and a bite indentation 250. It is anticipated that the flexible lid 200 may be composed of a flexible material including but not limited to: elastomers, rubbers, silicone, ethylene propylene rubber, ethylene propylene diene rubber, Epichlorohydrin rubber, Polyacrylic rubber, Fluorosilicone Rubber, Fluoroelastomers, Perfluoroelastomers, Polyether block amides, Chlorosulfonated polyethylene, Ethylene-vinyl acetate, Thermoplastic elastomers, resilin, elastin, Polysulfide rubber, Elastolefin, Synthetic polyisoprene, Polybutadiene, Chloroprene rubber, polychloroprene, Neoprene, Baypren, Butyl rubber, Halogenated butyl rubbers, Styrene-butadiene Rubber, Nitrile rubber (Buna N rubbers), Hydrogenated Nitrile Rubbers, Therban, or Zetpol. The other components of the twist ring container 10 could be composed of the same or of almost any other material including but not limited to: plastics, rubber, thermoplastics, metal, glass, carbon fiber, fiberglass, or ceramic.

When the lid assembly 100 depicted in FIG. 2 is assembled, the lid collar 110 will fit onto the flexible lid 200 and the top collar shoulder 140 will fit into the top seal channel 260. Once assembled, the lid assembly 100 is attached to the container body 300 (FIGS. 1, 3, 5 and 12) by way of the collar threads 120. It is envisioned that in other embodiments the lid assembly 100 could attach to the container body 300 in ways other than threads such as a snap lock, friction fit, magnetically, and the like.

The bite indentation 250 allows for a comfortable and proper place for the user to place their teeth when drinking such that the bite valve 270 (FIGS. 10-11) can be engaged. The spout reinforcement 240 creates more stiffness in the spout 230. This causes the spout 230 to return to its original shape when not being bitten and gives the spout 230 greater longevity and durability. The air valve 210 allows the equalization of pressure between the inside and outside of the twist ring container 10 when in use. The extended skirt 220 helps to form a seal when the lid assembly 100 is attached to the container body 300.

Figure 3:
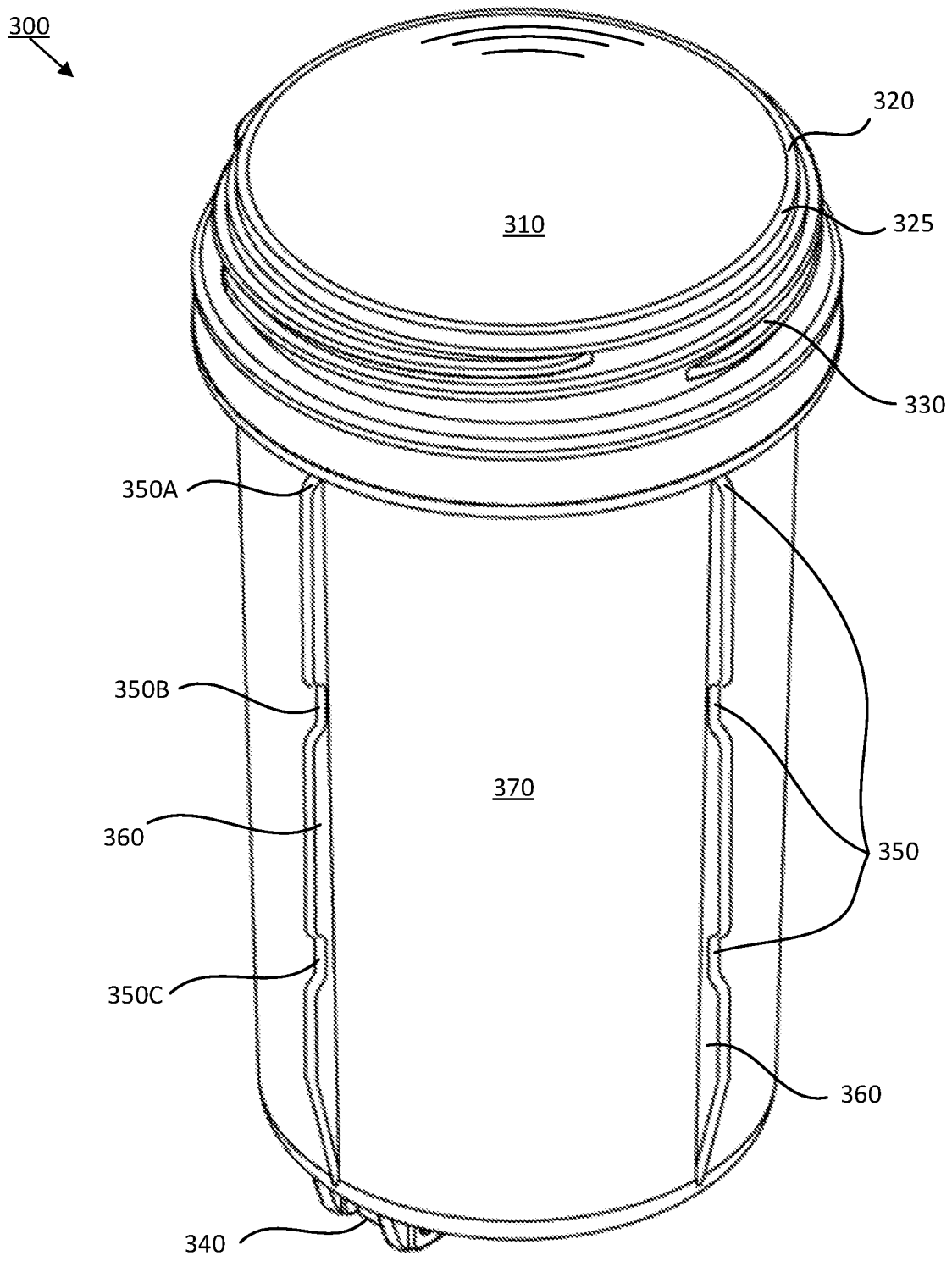
FIG. 3 is an upper perspective view of a container body.

In FIG. 3 the container body 300 is depicted along with its various features. The container interior 310 may contain objects or liquids. The container body 300 has a top surface 320 on an open end 325 that presses up against the extended skirt 220 of the flexible lid 200 when the lid assembly 100 is attached to the container body 300 and tightened. This compression of the flexible lid 200 between the bottom collar shoulder 150 (shown in FIGS. 10-11, and 13), the extended skirt 220, and the top surface 320 of the container body 300 forms a seal through which any fluid contained in the container interior 310 shall not pass.

The container body 300 is further shown to have container threads 330 adapted to engage with the collar threads 120 on the lid collar 110. As stated above, though the depicted embodiment of the twist ring container 10 possesses collar threads 120 and container threads 330, it is anticipated that further embodiments could make use of various alternate connection methods, devices, and/or structures. FIG. 3 also shows the container body 300 having an index 340 that functions to attach the base 500 to the container body 300.

As shown in FIG. 3, an outer surface 370 of the container body 300 may have at least one support rib 360. On the support rib(s) 360 are ring indent(s) 350. The ring indent(s) 350 may be sized similarly or differently making the individual indents differentiable from one another. In FIG. 3, these indents are differentiated into: a top ring indent 350A, a middle ring indent 350B, and a bottom ring indent 350C. The sizes of the ring indents 350A, 350B, 350C may be of different sizes, but it is envisioned in alternate embodiments that they could all be equal in size, that one might differ in size for the others, or that any combination of ring indents 350 could be the same size or differ in size from any other number for positional and/or alignment purposes described in more detail below.

Figure 4:
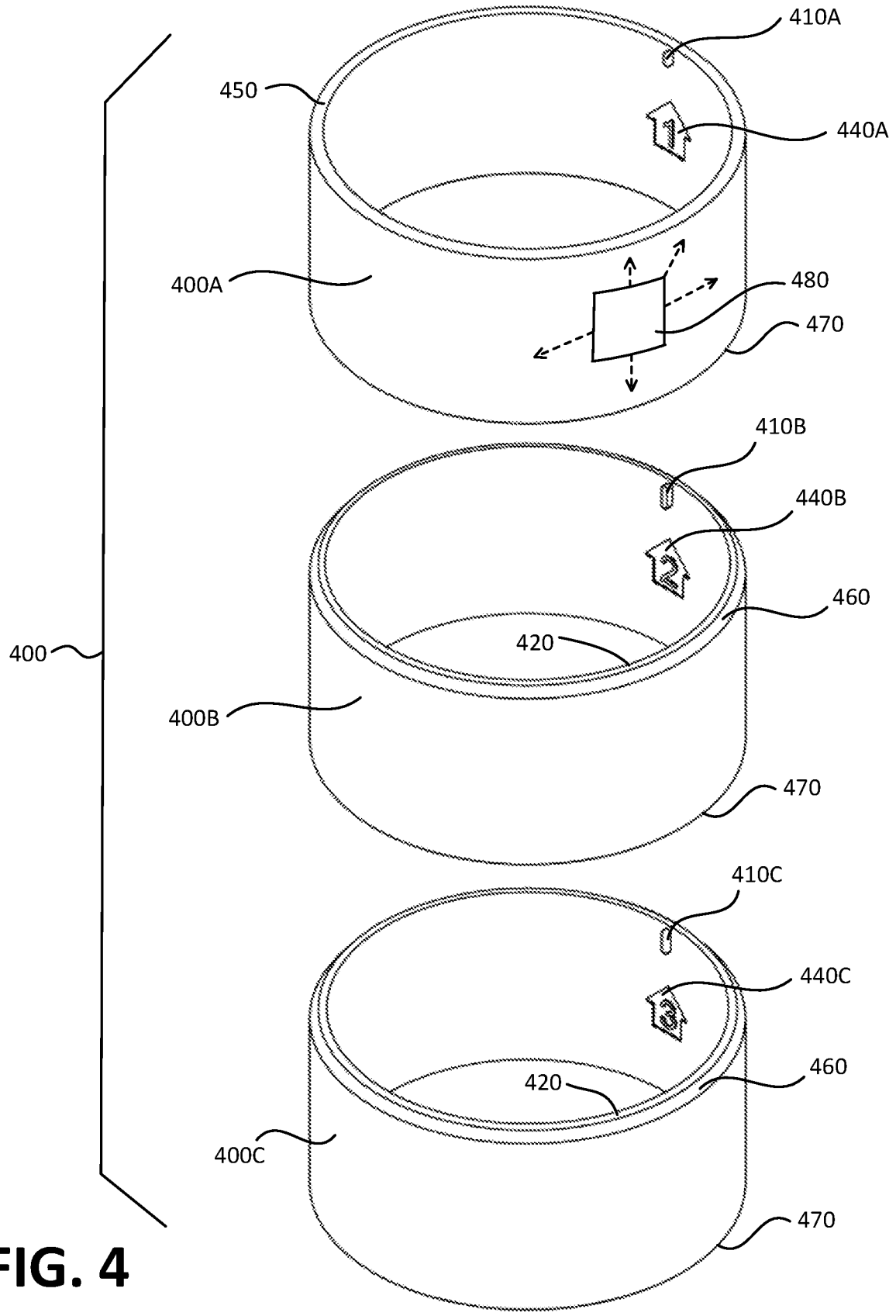
FIG. 4 is an upper perspective view of image rings.

FIG. 4 illustrates an exploded view of the image rings 400. The top image ring 400A has a top ring tab 410A, a first or top ring position indicator 440A, and a flat ring top 450. The middle image ring 400B has a middle ring tab 410B, a ring shoulder 420 on a first end 460, a second end 470, and a second or middle ring position indicator 440B. The bottom image ring 400C has a bottom ring tab 410C, a ring shoulder 420 on a first end 460, a second end 470, and a third or bottom ring position indicator 440C. The ring tab(s) 410A, 410B, 410C are designed to slide through the ring indent(s) 350 on the container body 300 when the image ring(s) 400 are placed on the container body 300.

Additionally, the image rings 400 may have subparts 480 as shown in FIG. 4, that move or shift, upwards, downwards, diagonally or in any other suitable direction according to this subject disclosure. This additional feature adds to the gameplay and/or entertainment value provided by the image rings 400.

Figure 5:
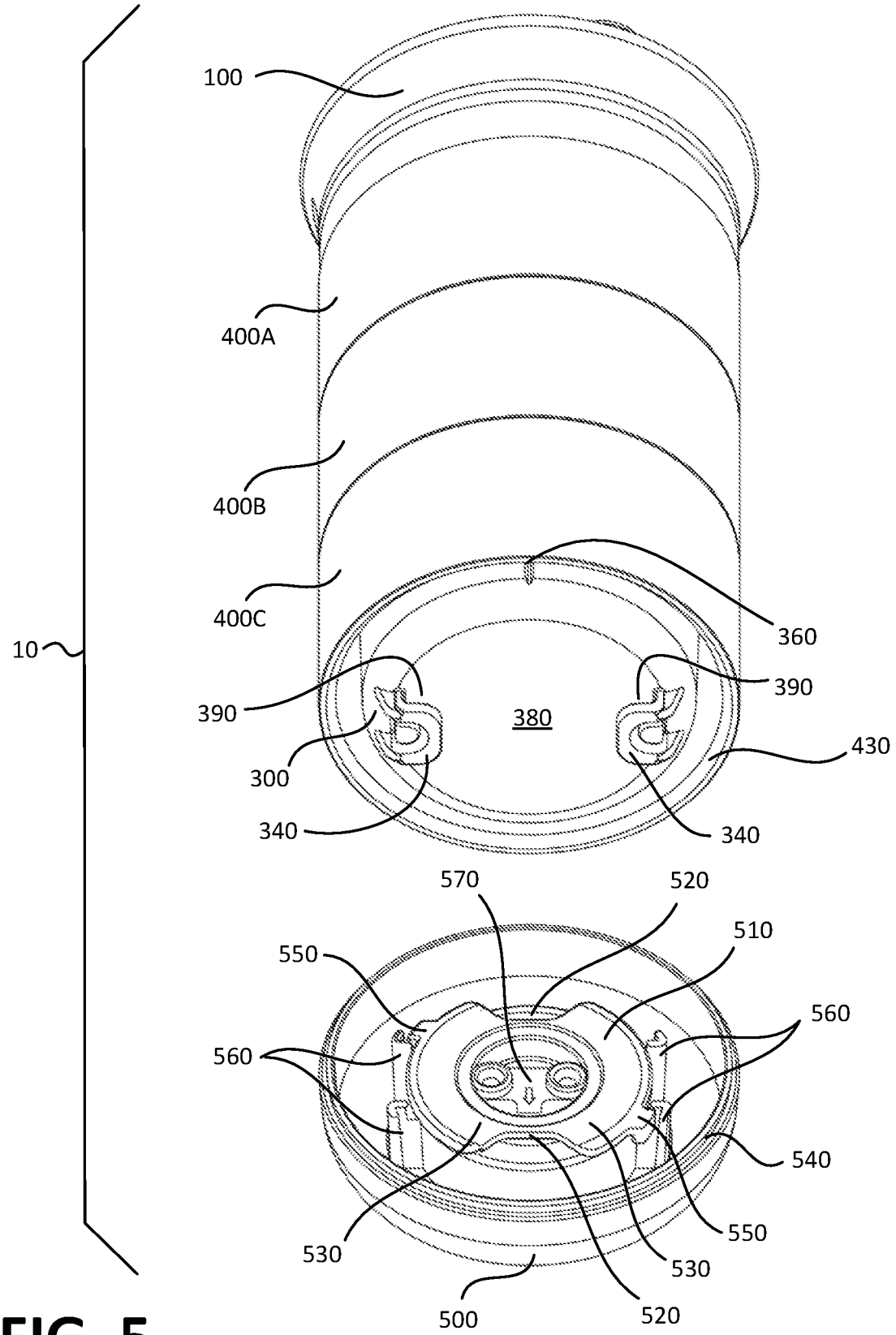
FIG. 5 is a perspective view of the twist ring container with a base unattached to the container body.

FIG. 5 depicts the twist ring container 10 in a partially-assembled state. The lid assembly 100 is shown attached to the container body 300 and the image rings 400A, 400B, 400C are shown installed around the container body 300. The support rib 360 can be seen between the image rings 400A, 400B, 400C and the container body 300. Although the illustrated embodiment has two indexes 340, it is envisioned that the function accomplished by the index(es) 340 could be fulfilled by one or more than two indexes 340. The illustrated embodiment of the subject disclosure is not intended to narrow the scope to any particular number of indexes 340.

FIG. 5 additionally depicts the ring recess 430 on the bottom image ring 400C. Ring recesses 430 may similarly be disposed on the second end 470 of the top image ring 400A and the second end 470 of the middle image ring 400B. The base shoulder 540 may fit into the ring recess 430 on the bottom image ring 400C when the twist ring container 10 is fully assembled.

FIG. 5 further illustrates various features of the base 500. The base 500 has a locking plate 510, a base shoulder 540, four backstops 560, and a connection mechanism 570. The locking plate 510 is comprised of two registers 520, two locking flanges 530, and two rotation cams 550. The number of registers 520 and locking flanges 530 will be at least equal to the number of indexes 340 on the container body 300.

When assembling the twist ring container 10, an index 340 will be aligned with and fit into a register 520. Due to the hook-like shape of the index 340, there is an index spacing 390, defined by the space between the index 340 and a bottom surface 380 of the container body 300. When the locking plate 510 is rotated in a first direction, the locking flange 530 fits into the index spacing 390, thus locking the base 500 and the image rings 400A, 400B, 400C to the container body 300.

When rotating the locking plate 510 in a first direction, the rotation cams 550 function to prevent the locking plate 510 from being rotated more than a predetermined rotational distance or an undesirable direction. This is accomplished by the backstops 560 blocking the rotation cams 550 when the rotation cams 550 come into contact with the backstops 560. As shown in FIG. 5, the two rotation cams 550 butt up against two of the four backstops 560. Further, if the locking plate 510 were to be rotated, the rotation cams 550 allow rotation in the first direction until they come into contact with the other two backstops 560. Unlocking the base 500 would be accomplished by rotating the locking plate 510 in a second direction until the rotation cams 550 come into contact with the other backstops 560.

Figure 6:
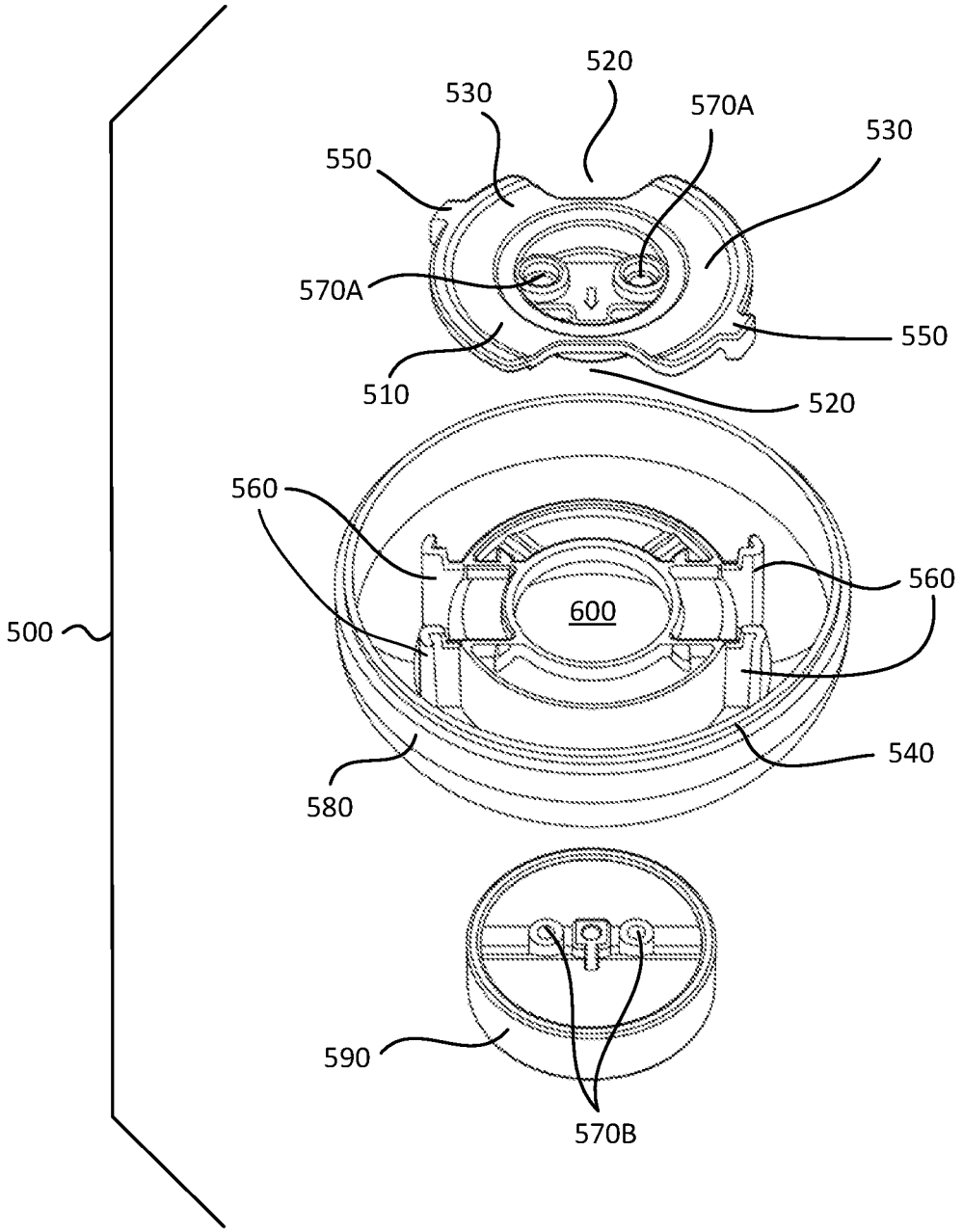
FIG. 6 is an upper perspective view of the base disassembled.

FIG. 6 depicts the various parts of the base 500. The parts depicted are the locking plate 510, the base body 580, and the locking knob 590. The locking plate 510 is shown as having two registers 520, two locking flanges 530, two rotation cams 550, and two locking plate screw holes 570A. In assembly, the locking plate 510 is located between the base body 580 and the bottom surface 380 of the container body 300.

The base body 580 is illustrated as having a base shoulder 540, four backstops 560, and a base body aperture 600. In assembly, the base body 580 is disposed over the locking knob 590.

The locking knob 590 is shown to have two locking knob screw holes 570B. The locking plate 510 may fit on top of the base body 580 and the locking knob 590 may fit on the bottom of the base body 580.

A connection mechanism 570 may include locking plate screw holes 570A and corresponding locking knob screw holes 570B. The locking plate 510 may then mechanically connect to the locking knob 590 through the base body aperture 600. The connection between the locking plate 510 and the locking knob 590 is a mechanical fixation such that, when the locking knob 590 is rotated the locking plate 510 will rotate likewise. The inverse is also true as when the locking plate 510 is rotated, the locking knob 590 will rotate likewise. The interface between the locking plate 510 and the base body 580 is such that the locking plate 510 is rotatable independently of the base body 580. Likewise, the interface between the base body 580 and the locking knob 590 is such that the locking knob 590 can rotate independently from the base body 580.

Though the base 500 illustrated in FIG. 6 has the number of each of these features that are shown, other embodiments may have any number of these features such as is practicable. For example, although the figures show a twist ring container 10 as having a connection mechanism 570 that consists of two locking plate screw holes 570A and two locking knob screw holes 570B that line up, one of each with a corresponding one of the other, such that screws or bolts (not depicted) will perform the mechanical connection through these features as described above, it is envisioned that other equally valid connection mechanisms 570 could be used to accomplish the mechanical connection described above; this includes but is not limited to: a single screw or bolt, more than two screws or bolts, any number of pin(s), any number of clip(s), any number of ring(s), any number of clip ring(s), glue(s), adhesive(s), tape(s), weldment(s), or the like.

Figure 7:
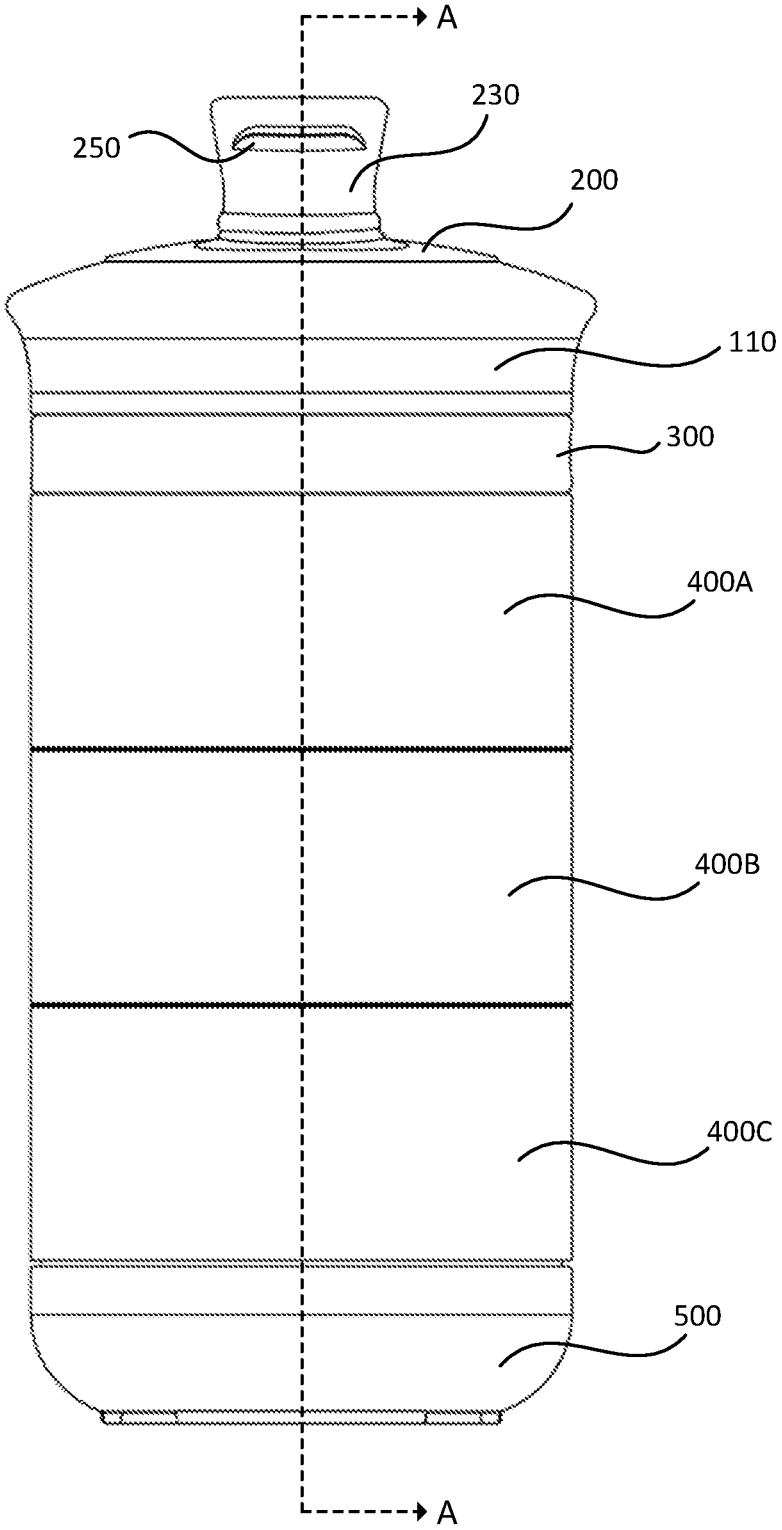
FIG. 7 is a front view of the twist ring container.

FIG. 7 shows a front view of the fully assembled and locked twist ring container 10 having a spout 230 and a bite indentation 250 on the flexible lid 200. The twist ring container 10 further has the lid collar 110, the three image rings 400A, 400B, 400C, and the base 500 secured to the container body 300.

Figure 8:
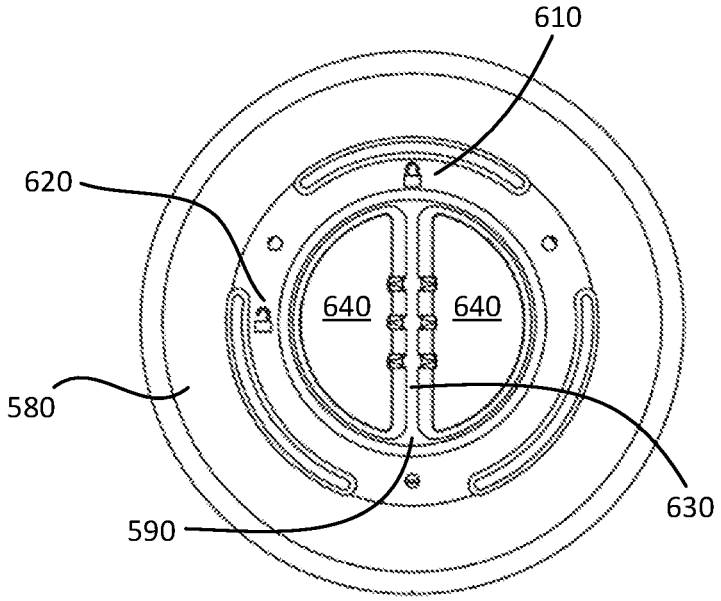
FIG. 8 is a bottom view of the twist ring container in a locked position.

FIG. 8 illustrates the bottom of the twist ring container 10 when assembled. The locking knob 590 is disposed in the base body 580 and has a knob handle 630 that is opposed on either side by two knob recesses 640. The locking knob 590 (and therefore the locking plate 510, not shown here) is in a locked state. The locked state is indicated by the knob handle 630 being inline with the locked indicator 610 and not with the unlocked indicator 620.

Figure 9:
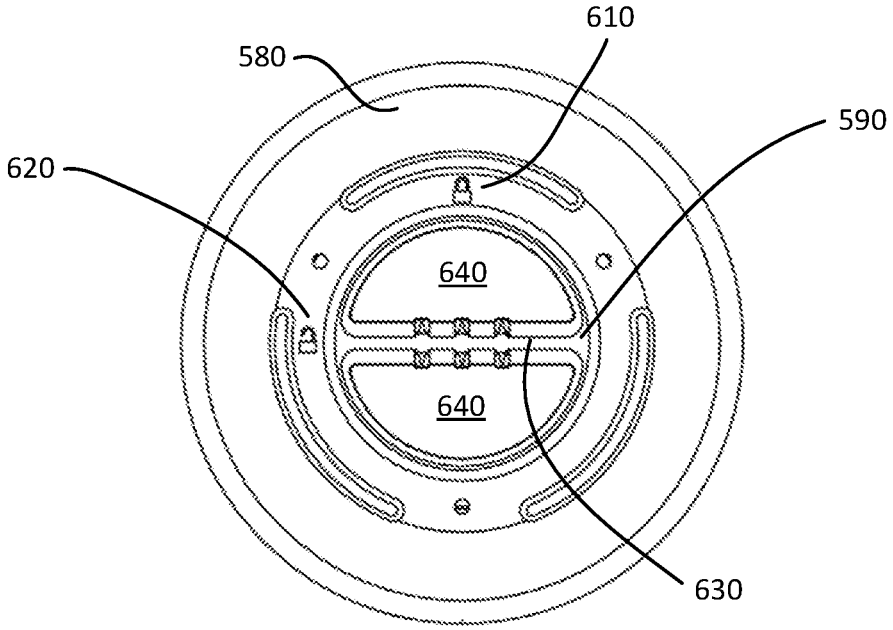
FIG. 9 is a bottom view of the twist ring container in an unlocked position.

FIG. 9 illustrates the bottom of the twist image container 10 when assembled with the locking knob 590 in an unlocked state. The unlocked state is indicated by the knob handle 630 being inline with the unlocked indicator 620 and not the locked indicator 610.

Figure 10:
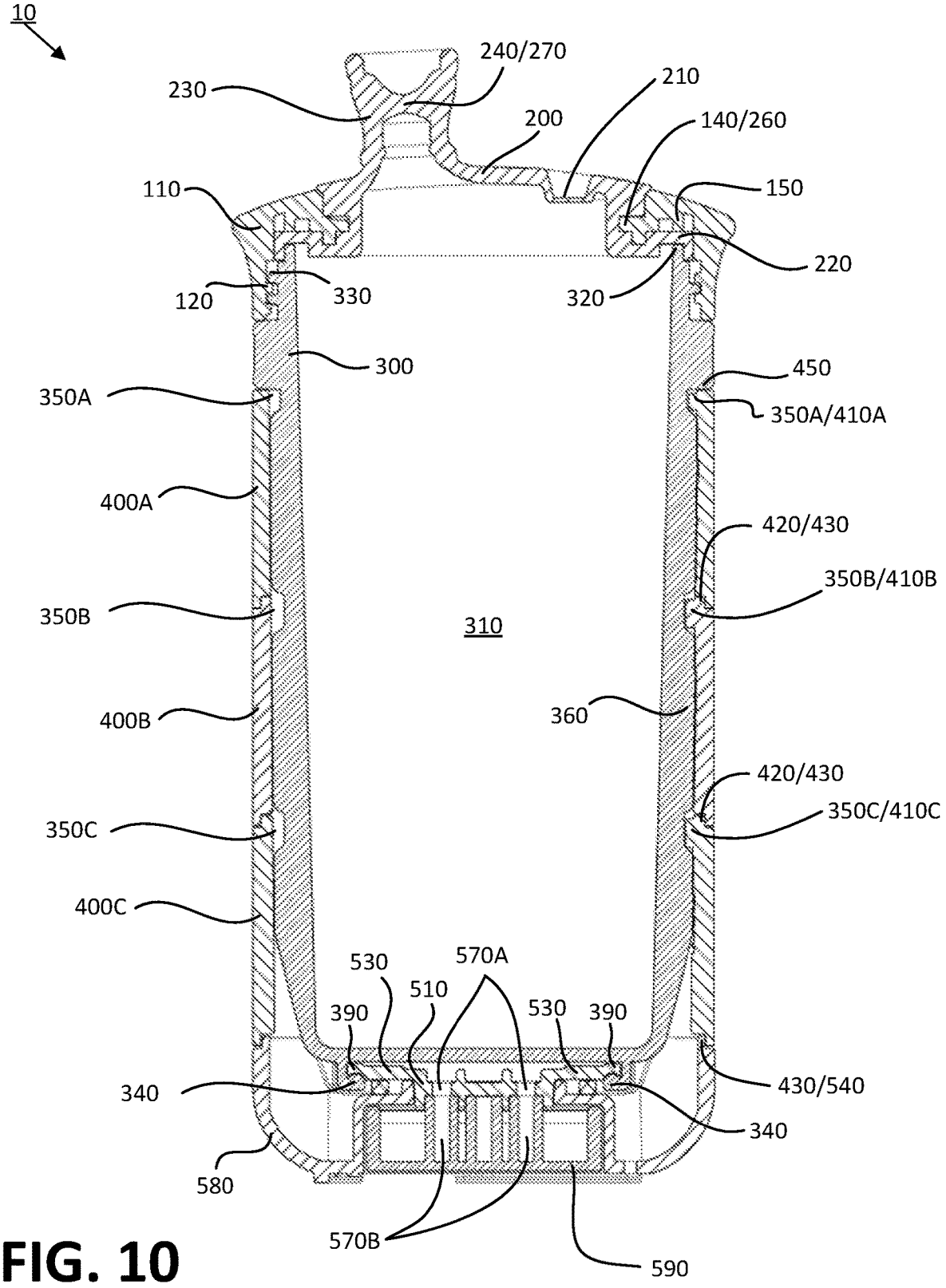
FIG. 10 is a cross-sectional view of the assembled twist ring container about line A-A shown in FIG. 7.

FIG. 10 is a cross-sectional view of the twist image container 10 fully assembled (about line A-A shown in FIG. 7). The container interior 310 is shown. The bite valve 270 and spout reinforcement 240 are shown disposed within the spout 230. The air valve 210 is shown as recessed on the flexible lid 200.

FIG. 10 also depicts the top collar shoulder 140 within the top seal channel 260. The interaction between the bottom collar shoulder 150, the extended skirt 220, and the top surface 320 of the container body 300 is shown. The collar threads 120 are shown engaged with the container threads 330. When the lid collar 110 is tightened onto the container body 300, the extended skirt 220 is compressed between the bottom collar shoulder 150 and the top surface 320 of the container body 300.

The top ring tab 410A is shown in one of the top ring indents 350A in the support rib 360 of the container body 300. The other top ring indent 350A is empty (shown in FIG. 10 on the opposite side from the first top ring indent 350A). This is likewise for the other ring tabs 410B, 410C and other ring indents 350B, 350C. The interaction of the ring tabs 410A, 410B, 410C with the ring indents 350A, 350B, 350C aids the rings in remaining aligned with respect to the container body 300. Ring tabs 410A, 410B, 410C could also be sized to differing heights, with corresponding differing heights of the ring indents 350A, 350B, 350C, creating a keyed condition whereby only a specific ring tab 410 could pass through a specific ring indent 350.

FIG. 10 further depicts the ring shoulders 420 fitting inside the ring recesses 430 between the middle image ring 400B and the top image ring 400A as well as between the bottom image ring 400C and the middle image ring 400B. The base shoulder 540 is shown sitting inside the ring recess 430 of the bottom image ring 400C. The top image ring 400A has a flat ring top 450 as there is no ring recess 430 above.

FIG. 10 demonstrates the locking flanges 530 of the locking plate 510 situated in a locked position positioned in the index spacing 390. The locking knob 590 is shown installed in the base body 580 and the locking plate screw holes 570A are depicted aligned with the locking knob screw holes 570B. FIG. 10 shows that, when the mechanical connection has fixed the locking knob 590 to the locking plate 510 through the base body 580, and the locking flanges 530 of the locking plate 510 are in the index spacing 390, the base 500 is then mechanically held onto the container body 300 by the indexes 340.

Figure 11:
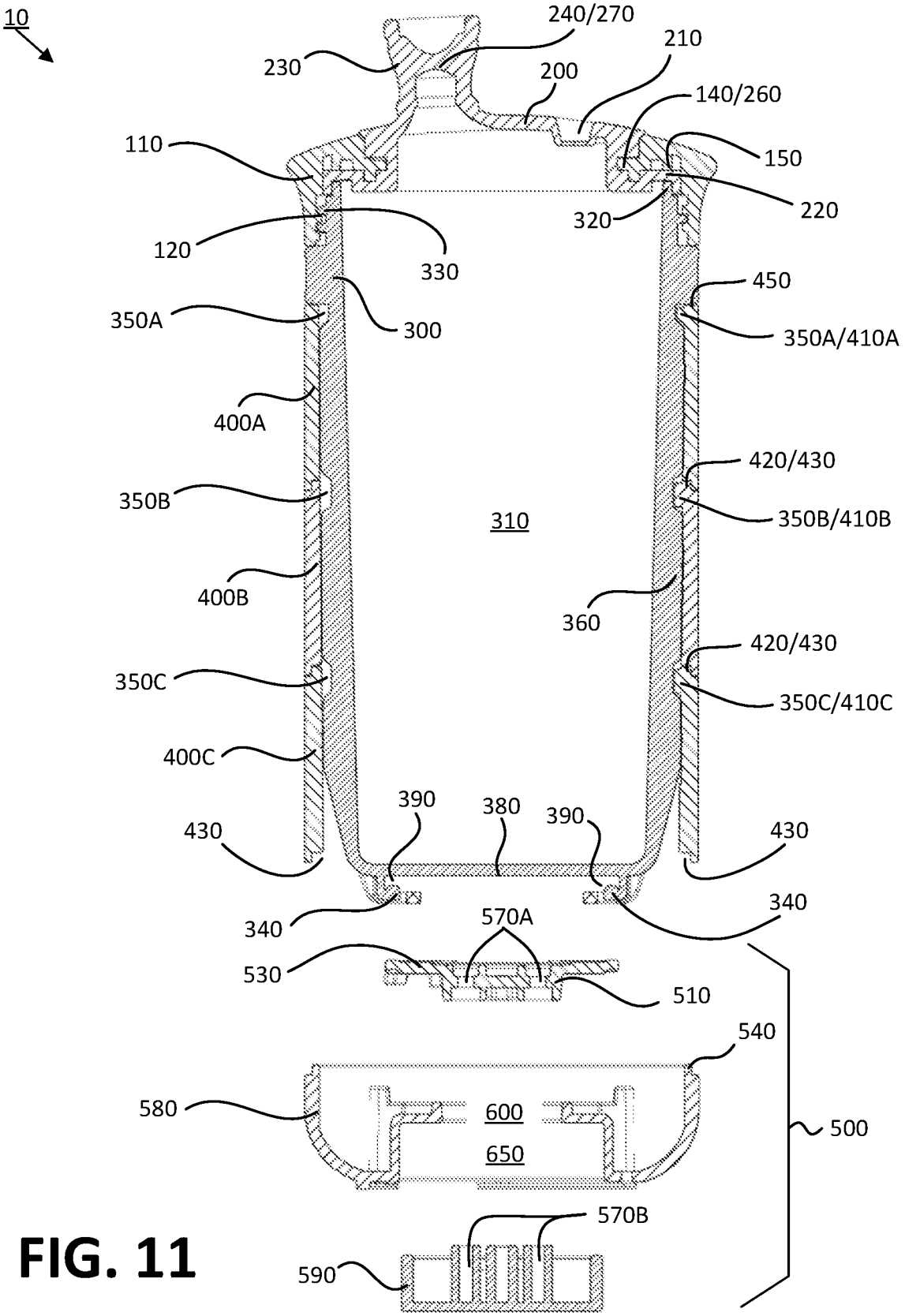
FIG. 11 is a cross-sectional view of the twist ring container with the disassembled base unattached to the container body.

FIG. 11 illustrates the twist ring container 10 when the base 500 is not installed on the container body 300 and the base 500 is disassembled. The index spacing 390 can be seen between the indexes 340 and the bottom surface 380 of the container body 300. With the locking plate 510 not attached to the locking knob 590 through the base body 580, the base body aperture 600 and the base body recess 650 can be seen. The locking knob 590 may sit within the base body recess 650 and the locking plate 510 may extend through the base body aperture 600 when the base 500 is assembled, as shown in FIG. 10.

Figure 12:
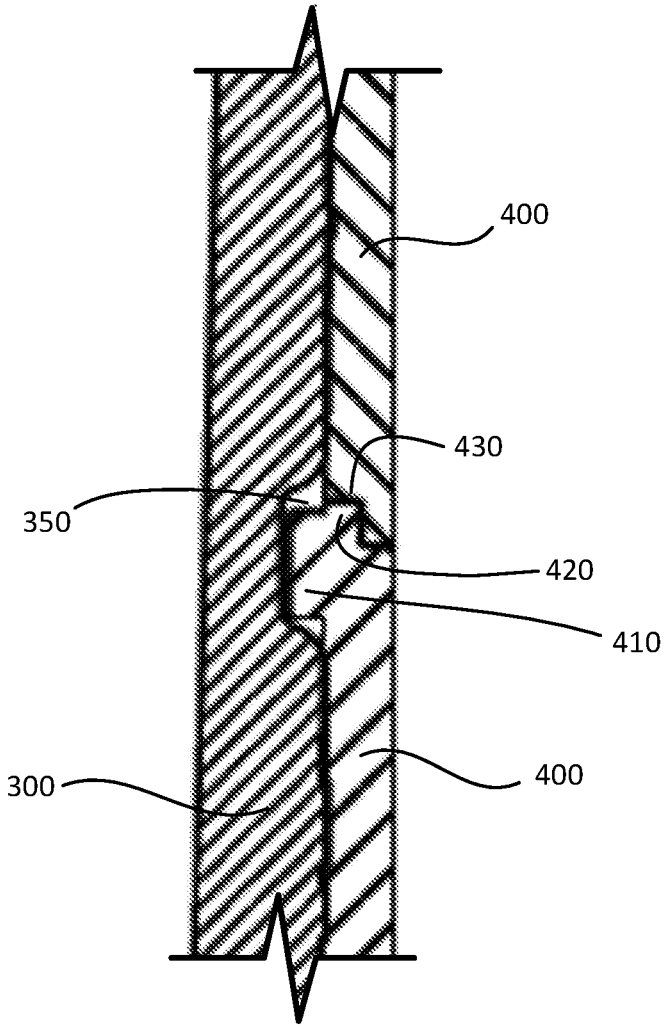
FIG. 12 is a closeup cross-sectional view of the rings mating with one another and the container body.

FIG. 12 illustrates the interaction of the ring tabs 410 with the ring indents 350 as well as the interaction of the ring shoulders 420 with the ring recesses 430 of the image rings 400. As mentioned previously, the sizing of the ring tabs 410 may be smaller than the ring indent 350 so that the ring tabs 410 I may pass through the ring indent 350 when the image ring 400 is rotated. However, if the ring tab 410 were larger than the ring indent 350, the ring tab 410 would not fit through the ring indent 350 when the image ring 400 is twisted. This allows for ring tabs 410 to be sized particularly for specific ring indents 350. Ring tabs 410 may only pass through ring indents 350 that are larger in size than that particular ring tab 410. This creates a first keyed condition whereby only certain image rings 400, with certain sized ring tabs 410, may be placed in positions that interact as seen in FIG. 12.

Additional embodiments of the subject disclosure could also feature ring shoulders 420 of differing sizes from one another with corresponding sizes of ring recesses 430 in which they are intended to fit. This would create a second keyed condition whereby only image rings 400 with ring shoulders 420 that are smaller than the ring recesses 430 of the image ring 400 above it can be installed in that position. This second keyed condition further defines what order each of the image rings 400 is able to be installed. The first keyed condition, mentioned above, and the second keyed condition may be used individually, in conjunction, or not at all, including alternative embodiments that may possess less than or more than three image rings 400.

Figure 13:
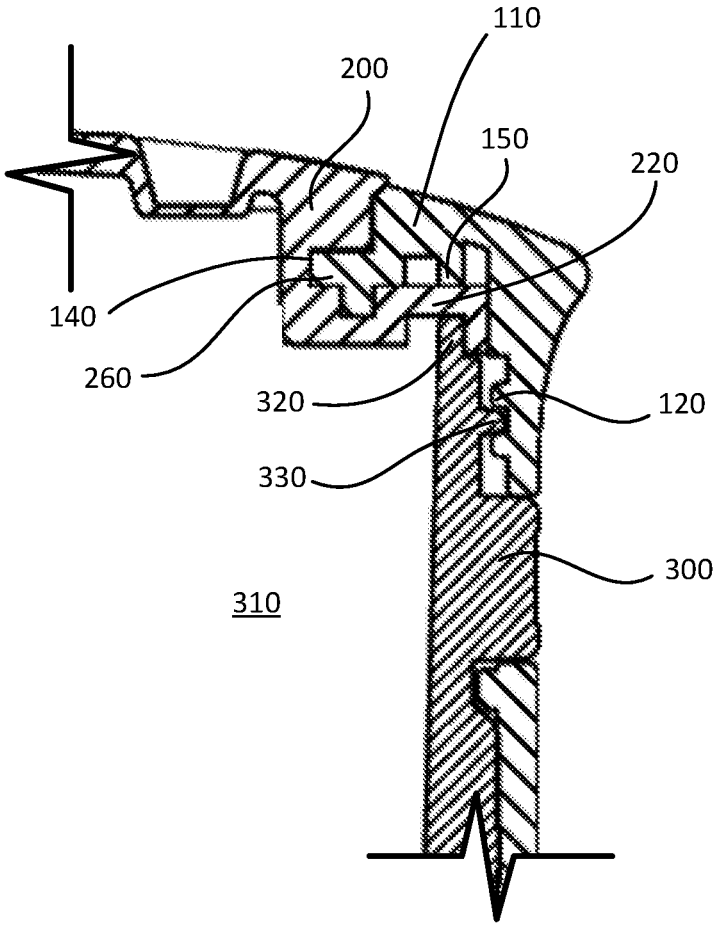
FIG. 13 is a closeup cross-sectional view of the mating of the flexible lid, the lid collar, and the container body.

FIG. 13 depicts a closeup, cross-sectional view of the interaction and fitment of the flexible lid 200, the lid collar 110, and the container body 300. The top collar shoulder 140 is shown within the top seal channel 260, forming a seal that resists the contents of the container interior 310 from passing out of the container interior 310 of the container body 300. As mentioned above, when the collar threads 120 and the container threads 330 engage, the lid collar 110 is pulled closer to the container body 300. In so doing, the bottom collar shoulder 150 is brought closer to the top surface 320 of the container body 300. The extended skirt 220 sits between the bottom collar shoulder 150 and the top surface 320, becoming compressed as the lid collar 110 is tightened onto the container body 300. This also forms a seal resisting the contents of the container interior 310 from passing out of the container interior 310 of the container body 300.

Figure 14:
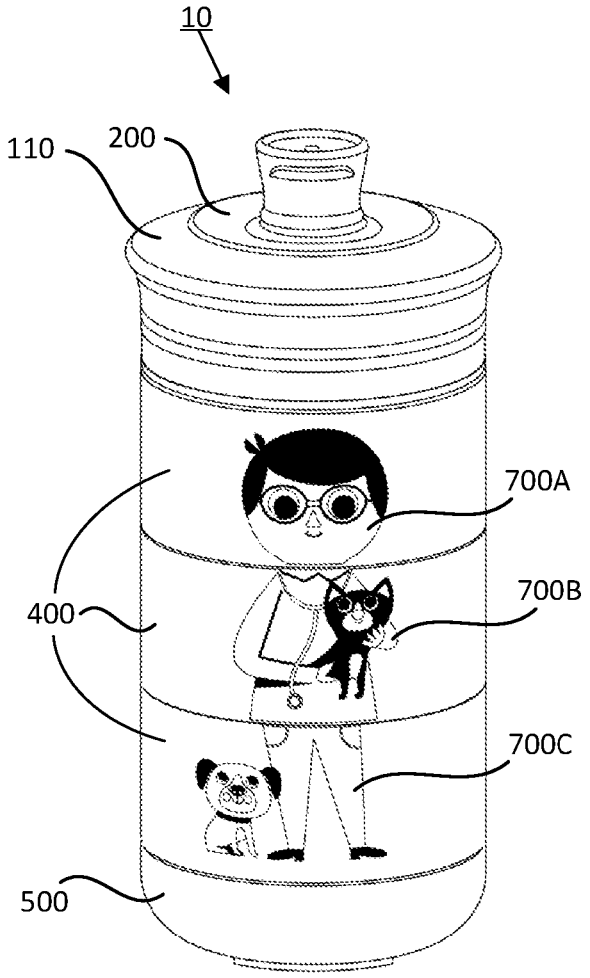
FIG. 14 is a perspective view of the twist ring container when the rings are aligned with respect to images on the rings.

FIG. 14 depicts the twist ring container 10 with: lid collar 110, flexible lid 200, image rings 400A, 400B, 400C, and base 500. The image rings 400 also have a first ring indicia 700A, a second ring indicia 700B, and a third ring indicia 700C. FIG. 14 shows that the ring indicia 700A, 700B, 700C align cooperatively to create a coherent image.

Figure 15:
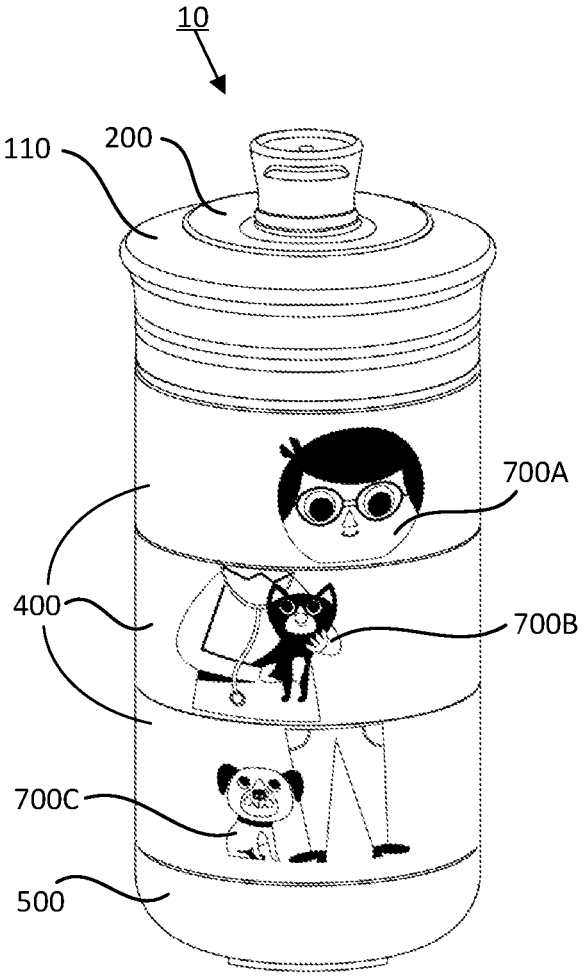
FIG. 15 is a perspective view of the twist ring container when the rings are not aligned with respect to images on the rings.

FIG. 15 depicts the same twist ring container 10 where the image rings 400 have been twisted, misaligning the ring indicia 700A, 700B, 700C that no longer form a coherent image until the indicia 700A, 700B, 700C line up again, allowing for the indicia 700A, 700B, 700C to line up in different combinations or display different information.

The illustrations and examples provided herein are for explanatory purposes and are not intended to limit the scope of the appended claims. It will be recognized by those skilled in the art, that changes or modifications may be made to the above described embodiment without departing from the broad inventive concepts of the subject disclosure. It is understood therefore that the subject disclosure is not limited to the particular embodiment described herein, but is intended to cover all modifications and changes within the scope and spirit of the subject disclosure.

What is claimed:

1. A container, comprising:

a container body having an open end, a bottom surface, and at least one supporting rib with at least one indent;

at least one ring adapted to fit around an outer surface of the container body, the ring completely covering the at least one supporting rib and having at least one tab that is adapted to align with and slide within at least one indent when the ring is twisted;

a base that secures onto the bottom surface of the container body; and a locking mechanism comprising:

a handle disposed on an outer surface of the base, the handle rotationally independent from the base and connected to a locking plate, wherein the locking plate connects the base to the container body.

2. The container recited in claim 1, wherein the at least one ring is a plurality of rings, further comprising:

a first end having a shoulder; and a second end having a recess, wherein the shoulder of each ring is adapted to fit into the recess of at least a one other ring located adjacent thereto.

3. The container recited in claim 2, further comprising a lid that secures onto the open end of the container body.

4. The container recited in claim 1, the locking mechanism further comprising: at least one register on the locking plate; and at least one index disposed on the bottom surface of the container body, wherein, to secure the base onto the container body: the index is aligned with and slid through the register and the handle is turned to rotate the locking plate to capture the locking index.

5. The container recited in claim 4, wherein the at least one ring is a plurality of the rings, each ring having:

a first end having a shoulder; and a second end having a recess, wherein the recess of each ring is adapted to receive the shoulder of at least one other ring located adjacent thereto.

6. The container recited in claim 1, further comprising:

a lid assembly having a flexible lid with a spout and a collar adapted to receive the flexible lid, wherein the lid assembly is adapted to be secured onto the open end of the container body.

7. The container recited in claim 6, wherein the flexible lid has an extended skirt that forms a seal between the open end of the container body and the collar.

8. A twist ring container, comprising:

a container body having an open end and a bottom surface;

a base;

one or more rings adapted to be stacked and placed around an outer surface of the container body; and a locking mechanism comprising:

a handle disposed on an outer surface of the base, the handle rotationally independent from the base and connected to a locking plate, the locking plate having at least one register; and at least one index on the bottom surface of the container body, the index adapted to align with and slide through the register when the base is placed on the bottom surface of the container body, wherein the base secures to the container body with the locking mechanism such that when the handle is gripped and rotated by a user, the locking plate rotates to capture the locking index.

9. The twist ring container recited in claim 8, further comprising:

a flexible lid having a spout; and a lid collar having threads and adapted to receive the flexible lid, wherein the container body has mating threads adapted to be secured to the threads of the lid collar.

10. The twist ring container recited in claim 9, wherein the flexible lid has an extended skirt that forms a seal between the container body and the lid collar.

11. The twist ring container recited in claim 8, wherein each ring has:

a first end having a shoulder; and a second end having a recess, wherein the shoulder of the ring is adapted to fit into the recess of at least a second ring located adjacent thereto.

12. The twist ring container recited in claim 8, further comprising a lid that secures onto the open end of the container body.

13. The twist ring container recited in claim 12, wherein each ring has:

a first end having a shoulder; and a second end having a recess, wherein the shoulder of each ring is adapted to fit into the recess of any other ring.

14. A container assembly, comprising:

a container body comprising:

an open end;

a bottom surface having at least one index; and an outer surface having at least one supporting rib with at least one indent;

at least one ring adapted to fit around the outer surface of the container body, the at least one ring completely covering the at least one supporting rib and having at least one tab adapted to slide within the at least one indent when the ring is twisted; and a base, that secures onto the bottom surface of the container body, the base comprising:

a locking mechanism comprising:

a handle disposed on an outer surface of the base, the handle rotationally independent from the base; and a locking plate connected to the handle the locking plate having at least one register, wherein the base secures onto the bottom surface of the container body when the locking index is captured by the locking plate.

15. The container assembly recited in claim 14, further comprising a lid.

16. The container assembly recited in claim 15, the at least one ring is a plurality of the rings, each ring having:

a first end having a shoulder; and a second end having a recess, wherein the recess of each ring is adapted to receive the shoulder of at least one other ring located adjacent thereto.

17. The container assembly recited in claim 16, where the shoulders on the rings are sized differently than the other shoulders.

18. The container assembly recited in claim 14, further comprising:

a flexible lid having a spout and an extended skirt; and a collar having threads, the collar adapted to receive the flexible lid, wherein the container body has mating threads adapted to secure the threads of the collar, the extended skirt forming a seal between the open end of the container body and the collar.

19. The container assembly recited in claim 18, wherein the at least one ring is a plurality of the rings, each ring having:

a first end having a shoulder; and a second end having a recess, wherein the shoulder of each ring is adapted to fit into the recess of at least one other ring located adjacent thereto.

20. The container assembly recited in claim 19, where the shoulder on each ring is adapted to fit into the recess on one other predetermined ring.

* * * * *